US005100435A

United States Patent [19]

Onwumere

[11] Patent Number: 5,100,435

[45] Date of Patent: Mar. 31, 1992

[54] MELTBLOWN NONWOVEN WEBS MADE FROM EPOXY/PCL BLENDS

[75] Inventor: Fidelis C. Onwumere, Miamisburg, Ohio

[73] Assignee: Kimberly-Clark Corporation, Neenah, Wis.

[21] Appl. No.: 622,258

[22] Filed: Dec. 4, 1990

[51] Int. Cl.[5] ..... D01D 5/12; D04H 1/72; D06M 11/59; D06M 13/332; D06M 101/00

[52] U.S. Cl. ..... 8/115.55; 8/115.65; 8/115.66; 8/115.67; 8/149.2; 156/167; 264/6; 264/12; 264/518; 264/210.8; 264/211.14; 264/211.16; 264/DIG. 75; 428/216; 428/311.5; 428/359; 428/373; 428/400

[58] Field of Search ..... 8/115.55, 115.65, 115.66, 8/115.67, 149.2; 156/167; 264/6, 12, 518, 210.8, 211.14, 211.16, DIG. 75; 428/216, 311.5, 359, 373

[56] References Cited

U.S. PATENT DOCUMENTS

| | | | |
|---|---|---|---|
| 3,016,599 | 1/1962 | Perry, Jr. | 28/78 |
| 3,632,687 | 1/1972 | Walter et al. . | |
| 3,704,198 | 11/1972 | Prentice . | |
| 3,734,979 | 5/1973 | Koleske et al. . | |
| 3,755,527 | 8/1973 | Keller et al. | 264/210 F |
| 3,781,381 | 12/1973 | Koleske et al. . | |
| 3,849,241 | 11/1974 | Butin et al. . | |
| 3,901,838 | 8/1975 | Clendinning et al. . | |
| 3,925,504 | 12/1975 | Koleske et al. . | |
| 3,978,185 | 8/1976 | Buntin et al. | 264/93 |
| 4,064,195 | 12/1977 | Baron et al. . | |
| 4,100,324 | 7/1978 | Anderson et al. | 428/288 |
| 4,118,531 | 10/1978 | Hauser | 428/224 |
| 4,475,998 | 10/1984 | Okitsu et al. | 204/159.15 |
| 4,540,729 | 9/1985 | Williams | 524/114 |
| 4,567,216 | 1/1986 | Qureshi et al. | 523/400 |
| 4,663,220 | 5/1987 | Wisneski et al. | 428/221 |
| 4,820,577 | 4/1989 | Morman et al. | 428/228 |

FOREIGN PATENT DOCUMENTS

| | | |
|---|---|---|
| 1153364 | 5/1969 | United Kingdom . |
| 2158081A | 11/1985 | United Kingdom . |

OTHER PUBLICATIONS

"TONE ® Polymers P-300 and P-700 High Molecular Weight Caprolactone Polymers", Union Carbide Corp., Brochure No. F-60456, Jun. 1988.

J. V. Koleske in "Polymer Blends", vol. 2, pp. 369-389 (1978), Academic Press.

N. K. Kalfoglou in Seferis et al., Editors, "Interrelations between Processing Structure . . . ", pp. 481-494 (1984).

R. E. Prud'homme, *Polymer Engineering and Science*, 22, No. 2, pp. 90-95 (1982).

M. M. Coleman and J. Zarian, *Journal of Polymer Science: Polymer Physics Edition*, 17, pp. 837-850 (1979).

L. M. Robeson, *Journal of Applied Polymer Science*, 17, pp. 3607-3617 (1973).

Chem. Abstr., 101:92135c (1984).

Chem. Abstr., 105:61500w (1986).

Chem. Abstr., 106:196976x (1987).

V. A. Wente et al., "Manufacture of Superfine Organic Fibers", Navy Research Laboratory, Washington, D.C., NRL Report No. 4364.

V. A. Wente, "Superfine Thermoplastic Fiber", *Industrial and Engineering Chemistry*, vol. 48, No. 8, pp. 1342-1346 (1956).

(List continued on next page.)

*Primary Examiner*—James C. Cannon

*Attorney, Agent, or Firm*—William E. Maycock

[57] ABSTRACT

Epoxy-based nonwoven webs are provided. The webs are formed by meltblowing a blend of an epoxy resin and a polycaprolactone (PCL) polymer. Whereas epoxy resins by themselves produce nonwoven webs which are brittle and glassy, epoxy/PCL blends have been found to produce webs which have good flexibility and elongation and are not glassy. If desired, once formed, the epoxy/PCL webs can be cured with, for example, an epoxy crosslinking agent to produce webs having enhanced solvent resistance properties.

25 Claims, 2 Drawing Sheets

OTHER PUBLICATIONS

R. R. Buntin and D. T. Lohkamp, *Journal of the Technical Association of the Pulp and Paper Industry,* vol. 56, pp. 74–77 (1973).

D. S. Hubbell and S. L. Cooper, *Journal of Applied Polymer Science,* 21, 3035–3061 (1977).

J. V. Koleske and R. D. Lundberg, *Journal of Polymer Science,* Part A-2, 7, pp. 795–807 (1969).

F. B. Khambatta et al., *Journal of Polymer Science: Polymer Physics Edition,* 14, pp. 1391–1424 (1976).

D. S. Hubbell et al. in S. L. Cooper et al., Editors, "Multiphase Polymers", Amer. Chem. Soc., Washington, 1979, pp. 517–528.

"Polycaprolactone Polymer PCL-700 Biodegradation and Molding Information", Union Carbide Corp., Brochure No. F-44453, 1973.

R. D. Fields et al., *Journal of Applied Polymer Science,* 18, pp. 3571–3579 (1974).

MELTBLOWN NONWOVEN WEBS MADE FROM EPOXY/PCL BLENDS

BACKGROUND OF THE INVENTION

1. Field of the Invention

This invention relates to meltblown nonwoven webs, and, in particular, to meltblown nonwoven webs made from a blend of an epoxy resin and a polycaprolactone ("PCL") polymer.

2. Description of the Prior Art

In the 1950's, the United States Naval Research Laboratory developed the meltblowing process for producing nonwoven webs from thermoplastic resins. See Wente et al., "Manufacture of Superfine Organic Fibers," Naval Research Laboratory Report No. 111437, Naval Research Laboratory, Washington, D.C., May 25, 1954; and Wente, Van. A., "Superfine Thermoplastic Fibers," Industrial and Engineering Chemistry, Vol. 48, No. 8, pages 1342–1346 (1956).

In overview, the process involves forming relatively small diameter fibers from the thermoplastic resin and then randomly depositing those fibers on, for example, a moving screen to form the nonwoven web. More particularly, the process comprises heating the resin to a molten state and then extruding the molten resin as threads or filaments from a die having a plurality of linearly arranged small diameter capillaries or orifices. The molten filaments exit the die into a high velocity stream of a heated gas which usually is air. The heated gas serves to attenuate, or draw, the filaments to form fibers having diameters which are less than the diameters of the capillaries of the die. The fibers thus obtained are usually deposited in a random fashion on a moving porous collecting device, such as a screen or wire, thereby resulting in the formation of the desired nonwoven web.

General discussions of the meltblowing process can be found in the Wente references referred to above, as well as in Buntin et al., "Melt Blowing—A One-Step Web Process for New Nonwoven Products," Journal of the Technical Association of the Pulp and Paper Industry, Vol. 56, No. 4, pages 74–77 (1973), the relevant portions of which are incorporated herein by reference. Specific examples of the technique can be found in U.S. Pat. No. 3,016,599 to Perry, Jr., U.S. Pat. No. 3,704,198 to Prentice, U.S. Pat. No. 3,755,527 to Keller et al., U.S. Pat. No. 3,849,241 to Butin et al., U.S. Pat. No. 3,978,185 to Buntin et al., U.S. Pat. No. 4,100,324 to Anderson et al., U.S. Pat. No. 4,118,531 to Hauser, U.S. Pat. No. 4,663,220 to Wisneski et al., and U.S. Pat. No. 4,820,577 to Morman et al., the relevant portions of which are also incorporated herein by reference.

Although meltblowing has been performed with a variety of thermoplastic resins, to date, the technique has not been successfully applied to epoxy resins. Indeed, in the course of developing the present invention, attempts were made to meltblow lower molecular weight epoxy resins. In each case, the result was a glassy and very brittle non-bonded web, totally unsuitable for commercial use, e.g., as a nonwoven fabric.

This inability to produce useful products through the meltblowing of epoxy resins is a significant deficit in the art both because meltblowing is a highly effective and economical method for producing nonwoven products and because epoxy-based materials have excellent physical and chemical properties, including toughness, good dielectric properties, and good corrosion and chemical resistance. As discussed in detail below, the present invention addresses this problem in the art by providing blends of epoxy resins, specifically, blends with PCL polymers, which can be meltblown to form nonwoven webs. Surprisingly, the webs have enhanced physical and chemical properties characteristic of an epoxy resin, and yet are neither glassy nor brittle.

Some combinations of polycaprolactones with epoxy resins have been reported in the literature. For example, Union Carbide Corporation's 1988 product brochure entitled "TONE® Polymers P-300 and P-700 High Molecular Weight Caprolactone Polymers" (Brochure No. F-60456 at page 9), lists epoxies as one type of a number of polymers which are mechanically compatible, but not miscible, with polycaprolactones.

Similarly, U.S. Pat. No. 4,567,216 to Qureshi et al., describes an epoxy resin system which comprises an epoxy resin, specifically bis(2,3-epoxycylopentyl) ether, a hardener, and a thermoplastic polymer which can be a polycaprolactone. The composition is used to prepare fiber-reinforced composites for making aircraft parts and the like. Along these same lines, U.S. Pat. No. 4,540,729 to Williams discloses a molding composition which comprises a polyethylene terephthalate polyester, a nucleant for crystallizing the polyester, an epoxidised unsaturated triglyceride, and a polycaprolactone. See also Japanese Patent Publication No. 59/030,817 [Chem. Abstr., 101:92135*c* (1984)] which describes reacting polycaprolactones with dicarboxylic anhydrides and mixing the resulting adducts with an alicyclic epoxy resin to produce a molding composition. Cured resin moldings made from the composition are said to have excellent flexibility, toughness, and electrical properties, making them suitable for use as electrical insulating material.

Lactones have also been used to modify polymers, including polymers containing epoxy groups. Thus, U.S. Pat. No. 4,475,998 to Okitsu et al. describes the preparation of a lactone-modified epoxy (meth)acrylate resin which is combined with a vinyl compound having an ethylenically unsaturated bond and a photosensitizer to produce a hardenable resin composition. The addition of the lactone is said to improve the flexibility of the epoxy (meth)acrylate resin. Similarly, Japanese Patent Publication No. 61/004,773 [Chem. Abstr., 105:61500*w* (1986)] discloses a prepregnated cloth for use as an insulating material for electrical machines wherein the resin used to impregnate the cloth includes, among other ingredients, an epoxy resin and a caprolactone-modified epoxy resin. See also Japanese Patent Publication No. 61/241,321 [Chem. Abstr., 106:196976*x* (1987)] which discloses the preparation of spiro ortho esters by reacting an epoxy compound with a lactone and the use of such compounds to surface treat carbon substances, such as graphites; U.K. Patent Application Serial No. 2,158,081 which describes a graft polymer of cellulose and caprolactone which can be used as a coating resin or a molding material; and U.K. Patent No. 1,153,364 which discloses a process for the production of $\epsilon$-caprolactone and states that the resulting product can be polymerized or copolymerized with epoxides to form synthetic resins and fibers.

In addition to the above references, a variety of theoretical studies have been performed on blends and mixtures of polycaprolactone polymers with other polymers, including poly(vinyl chloride), bisphenol epoxy resins prepared from bisphenol A and epichlorohydrin, cellulosic polymers, polyepichlorohydrin, a chlorinated polyether, poly(vinyl acetate), polystyrene, poly(methyl methacrylate), poly(vinyl butyral), poly(vinyl alkyl ethers), polysulfone, polycarbonates, natural and synthetic rubbers, polyethylene, chlorinated polyethylene, polypropylene, and polyurethanes. See Koleske, J. V., "Blends Containing Poly(ε-Caprolactone) and Related Polymers" in "Polymer Blends", Vol. 2, pages 369–389 (1978); Kalfoglou, N. K., "Mechanical and Thermal Characterization of Poly-(ε-Caprolactone)-Chlorinated Polyethylene Blends" in Seferis, J. C. and Theocans, P. S., Editors, "Interrelations between Processing Structure and Properties of Polymeric Materials", pages 481–494 (1984); Prud'homme, R. E., "Miscibility Phenomena in Polyester/Chlorinated Polymer Blends," *Polymer Engineering and Science,* 22, No. 2, pages 90–95 (1982); Coleman, M. M. and Zarian, J., "Fourier-Transform Infrared Studies of Polymer Blends. II. Poly(ε-Caprolactone)-Poly(Vinyl Chloride) System," *Journal of Polymer Science: Polymer Physics Edition,* 17, pages 837–850 (1979); Robeson, L. M., "Crystallization Kinetics of Poly-ε-Caprolactone from Poly-ε-Caprolactone/Poly(vinyl Chloride) Solutions," *Journal of Applied Polymer Science,* 17, pages 3607–3617 (1973); Hubbell, D. S. and Cooper, S. L., "The Physical Properties and Morphology of Poly-ε-Caprolactone Polymer Blends," *Journal of Applied Polymer Science,* 21, pages 3035–3061 (1977); Koleske, J. V. and Lundberg, R. D., "Lactone Polymers. I. Glass Transition Temperature of Poly-ε-Caprolactone by Means of Compatible Polymer Mixtures," *Journal of Polymer Science, Part A-2,* 7, pages 795–807 (1969); Khambatta, F. B., Warner, F., Russell, T., and Stein, R. S., "Small-Angle X-Ray and Light Scattering Studies of the Morphology of Blends of Poly(ε-Caprolactone) with Poly(vinyl Chloride)," *Journal of Polymer Science: Polymer Physics Edition,* 14, pages 1391–1424 (1976); and Hubbell, D. S. and Cooper, S. L., "Segmental Orientation, Physical Properties, and Morphology of Poly-ε-Caprolactone Blends," in S. L. Cooper and G. M. Estes, Editors, "Multiphase Polymers," Advances in Chemistry Series 176, American Chemical Society, Washington, D.C., 1979, pp. 517–528. See also U.S. Pat. No. 3,901,838 to Clendinning et al.; U.S. Pat. No. 4,064,195 to Baron et al.; U.S. Pat. No. 3,925,504 to Koleske et al.; U.S. Pat. No. 3,632,687 to Walter et al.; U.S. Pat. No. 3,734,979 to Koleske et al.; and U.S. Pat. No. 3,781,381 to Koleske et al.

Notwithstanding the extensive efforts that have gone into the study of blends of polycaprolactone polymers, none of the foregoing references discloses or in any way suggests the use of these polymers in the preparation of meltblown webs from epoxy resins.

SUMMARY OF THE INVENTION

In view of the foregoing state of the art, it is an object of the present invention to provide a method for meltblowing epoxy resins. More particularly, it is an object of the invention to provide a method for meltblowing epoxy resins so as to produce nonwoven webs which have good flexibility and elongation and are nonglassy.

It is a further object of the invention to provide meltblown nonwoven webs comprising fibers which are composed of one or more epoxy resins and one or more polycaprolactone polymers. It is an additional object of the invention to provide nonwoven webs of the foregoing type wherein the epoxy groups have been crosslinked so as to provide a web having solvent resistance properties.

To achieve the foregoing and other objects, the invention provides a method for meltblowing an epoxy resin comprising the steps of:

(a) forming a molten blend comprising an epoxy resin component which is composed of one or more epoxy resins and a polycaprolactone component which is composed of one or more polycaprolactone polymers;

(b) extruding the molten blend through a plurality of orifices to form filaments;

(c) attenuating the filaments with flowing heated gas so as to produce fibers whose cross-sectional dimensions are less than the cross-sectional dimensions of the orifices; and (d) collecting the fibers in the form of a nonwoven web.

In certain preferred embodiments, the epoxy resin component comprises on the order of 50–70% by weight of the molten blend, and the polycaprolactone component comprises approximately 30–50%. Also, the number-average molecular weights of the epoxy resin and polycaprolactone components are preferably from about 900 to about 8,000 and from about 30,000 to about 60,000, respectively.

In other preferred embodiments, the nonwoven web is contacted with a curing agent which reacts with the epoxy groups of the epoxy resins. Most preferably, the curing agent is of the crosslinking type so as to produced a web which is resistant to solvents. Suitable curing agents of this type include ammonia, primary diamines, and polyfunctional amines.

In addition to its method aspects, the invention also provides nonwoven webs composed of an epoxy resin and a polycaprolactone polymer. More particularly, the invention provides nonwoven webs made up of fibers which comprise at least about 50 percent by weight of one or more epoxy resins and at least about 30 percent by weight of one or more polycaprolactone polymers. The invention also provides nonwoven epoxy/polycaprolactone webs which have been treated with a curing agent which reacts with epoxy groups and, most preferably, with a curing agent of the crosslinking type.

In connection with the product aspects of the invention, the term "nonwoven web" is intended to mean a web of material which has been formed without the use of a weaving process, i.e., without the use of a process which produces a structure of individual fibers or threads which are interwoven in an identifiable repeating manner. Similarly, the term "fiber" is used to refer to small diameter fibers having an average diameter not greater than about 100 microns, preferably from about 0.1 micron to about 50 microns, and more preferably from about 1 micron to about 40 microns.

The accompanying drawings, which are incorporated in and constitute part of the specification, illustrate the preferred embodiments of the invention, and together with the description, serve to explain the principles of the invention. It is to be understood, of course, that both the drawings and the description are explanatory only are not restrictive of the invention.

DETAILED DESCRIPTION OF THE INVENTION

Figure 1:
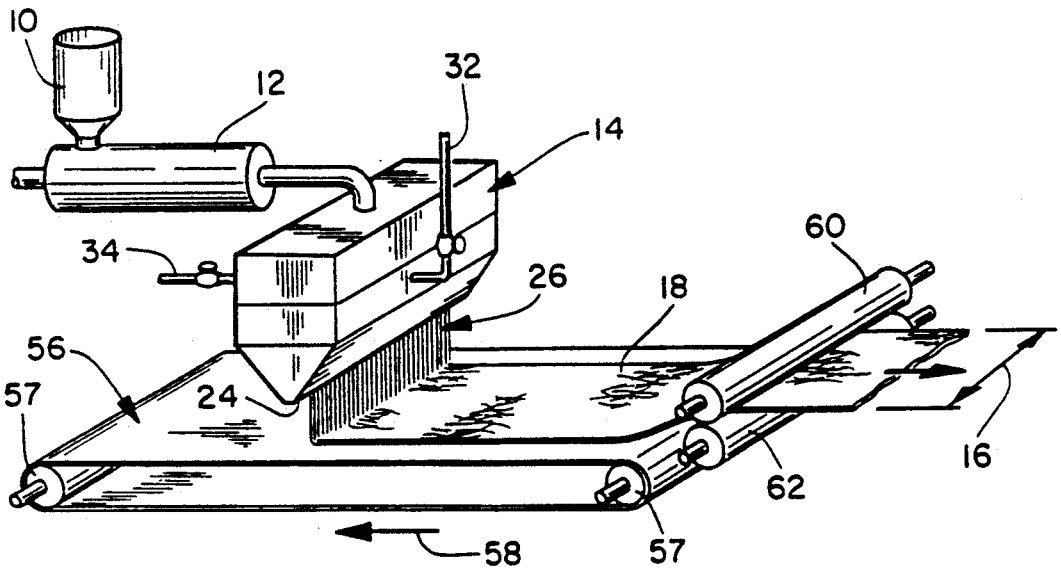
FIG. 1 is a perspective schematic view illustrating one embodiment of a process for forming a nonwoven web in accordance with the present invention.

As discussed above, the present invention relates to the production of epoxy-based nonwoven webs by the formation of an epoxy/PCL blend and the meltblowing of that blend to produce the desired web.

Various epoxy resins can be used in the practice of the invention, provided that the resin's melting and flow characteristics are suitable for forming a nonwoven web. Bisphenol A/epichlorohydrin epoxy resins which have number-average molecular weights between about 900 and about 8,000 have been found well-suited to the practice of the invention. Other epoxy resins can be used if desired. Also, the epoxy resin component of the epoxy/PCL blend can be composed of two or more epoxy resins of different types and/or different molecular weights. If the web is to be treated with a crosslinking curing agent, the epoxy resin should have a functionality (i.e., the number of epoxy moieties per molecule) of 2 or greater.

Various polycaprolactone polymers can be used in the practice of the invention. At present, PCL polymers are commercially produced by the Union Carbide Corporation (Danbury, Conn.) and sold under the TONE® trademark. Union Carbide offers PCL in three grades: TONE® P-300 having a number average molecular weight of approximately 11,000, TONE® P-700 having a number average molecular weight of approximately 46,000, and TONE® P-767 which also has a molecular weight of about 46,000 but has been further purified to have less odor.

Either of the P-700 or P-767 grades can be successfully used in the practice of the invention. The P-300 grade, due to its low molecular weight and thus low melt viscosity, is in general not well-suited for meltblowing with conventional meltblowing equipment. However, blends of P-300 with P-700 and/or P-767, e.g., blends of up to 50% P-300, can be successfully used. In general terms, the number average molecular weight of the polycaprolactone component of the epoxy/PCL blend should be in the range from about 30,000 to about 60,000.

It should be noted that polycaprolactone polymers are biodegradable, i.e., they undergo assimilation by microorganisms when in contact with moist soil which has not been sterilized. See "Polycaprolactone Polymer PCL-700 Biodegradation and Molding Information," Union Carbide Corporation, Product Brochure No. F-44453, 1973; and Fields, R. D., Rodriguez, F., and Finn, R. K., "Microbial Degradation of Polyesters: Polycaprolactone Degraded by *P. pullulans*," *Journal of Applied Polymer Science*, 18, pages 3571-3579 (1974). Accordingly, the nonwoven webs of the present invention can be at least partially biodegraded upon disposal in, for example, a landfill or composting site.

In addition to an epoxy resin component and a polycaprolactone component, the nonwoven webs of the present invention can include other materials or additives known in the meltblowing art for imparting specific properties or characteristics to the final web. For example, the webs of the present invention also can contain, by way of illustration only, fillers, such as aluminum silicate hydrate (clay), aluminum silicate (calcined clay), magnesium silicate (talc), potassium aluminum silicate (mica), calcium carbonate (calcite or whiting), silica (diatomaceous earth), titanium dioxide, barium sulfate (barytes), and the like; colorants, i.e., dyes and pigments, the latter of which may be either inorganic or organic; processing aids; lubricants; fungicides; flame retardants; antistatic agents, such as quaternary ammonium compounds, and the like; brighteners; antioxidants; and the like.

As discussed above, the epoxy/PCL nonwoven webs of the invention are formed by a meltblowing process. As a first step in the process, the epoxy resin component and the PCL component are blended together. Any device designed to mix a polymer can be used for this step. For example, a Brabender extruder equipped with a mixing screw can be used for this purpose.

The blending is conducted at a temperature above the melting point of both the epoxy resin and the polycaprolactone polymer, and below both of their decomposition temperatures. Blending to the point where the mixture is visibly homogeneous is sufficient. Once homogeneity has been achieved, the blend is typically cooled and formed into, for example, pellets for further processing. Alternatively, the further steps of the process can be performed directly on the molten blend.

Once the blend has been formed, the next steps in the process transform the blend into thin filaments which are then attenuated to form the fibers of the nonwoven web. Suitable apparatus for performing these steps is shown schematically in FIGS. 1-3, wherein like reference characters designate like or corresponding parts throughout the several views.

As shown in FIG. 1, the overall apparatus includes an extruder 12 having a hopper 10 for receiving pellets of the epoxy/PCL blend. If desired, the polymer in the hopper 10 may be maintained under an inert atmosphere, such as nitrogen.

The temperature of the epoxy/PCL blend is elevated within the extruder 12 by a conventional heating arrangement (not shown) to melt the blend. The blend typically will be heated to a temperature in the range of from about 100° to about 118° C. Pressure is applied to the blend by the action of a rotating screw (not shown), located within the extruder, to convert the blend into an extrudable condition. The extrudable blend then is forwarded by the pressure-applying action of the rotating screw to meltblowing die 14.

The elevated temperature of the extrudable blend is maintained in meltblowing die 14 by a conventional heating arrangement (not shown). The die 14 generally extends a distance which is about equal to the width 16 of the nonwoven web 18 which is formed by the process. The combination of elevated temperature and elevated pressure conditions which effect extrusion of the composition will vary over wide ranges. For example, at higher elevated temperatures, lower elevated pressures will result in satisfactory extrusion rates and, at higher elevated pressures of extrusion, lower elevated temperatures will effect satisfactory extrusion rates.

Figure 2:
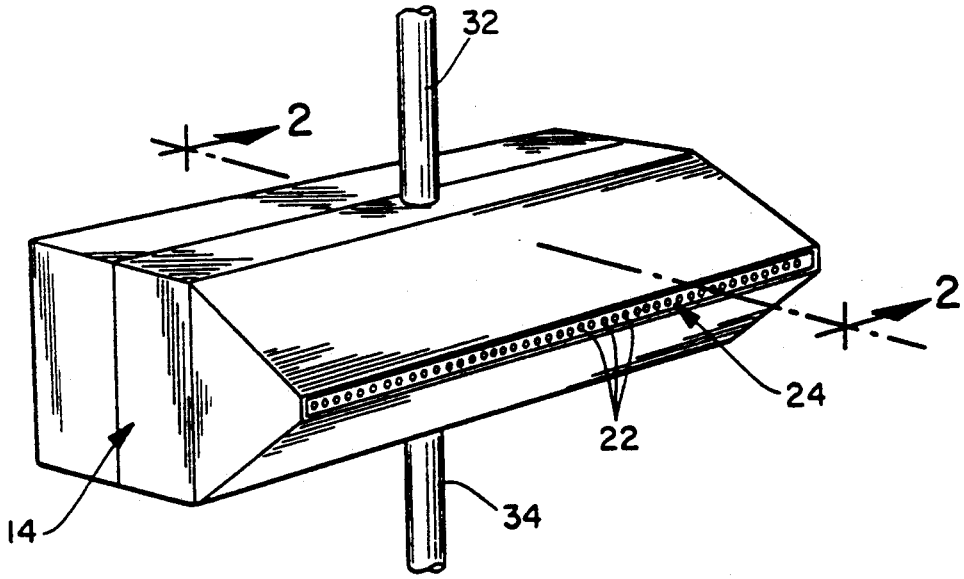
FIG. 2 is a perspective view of the meltblowing die shown in FIG. 1 which illustrates the linear arrangement of the capillaries of the die.
Figure 3:
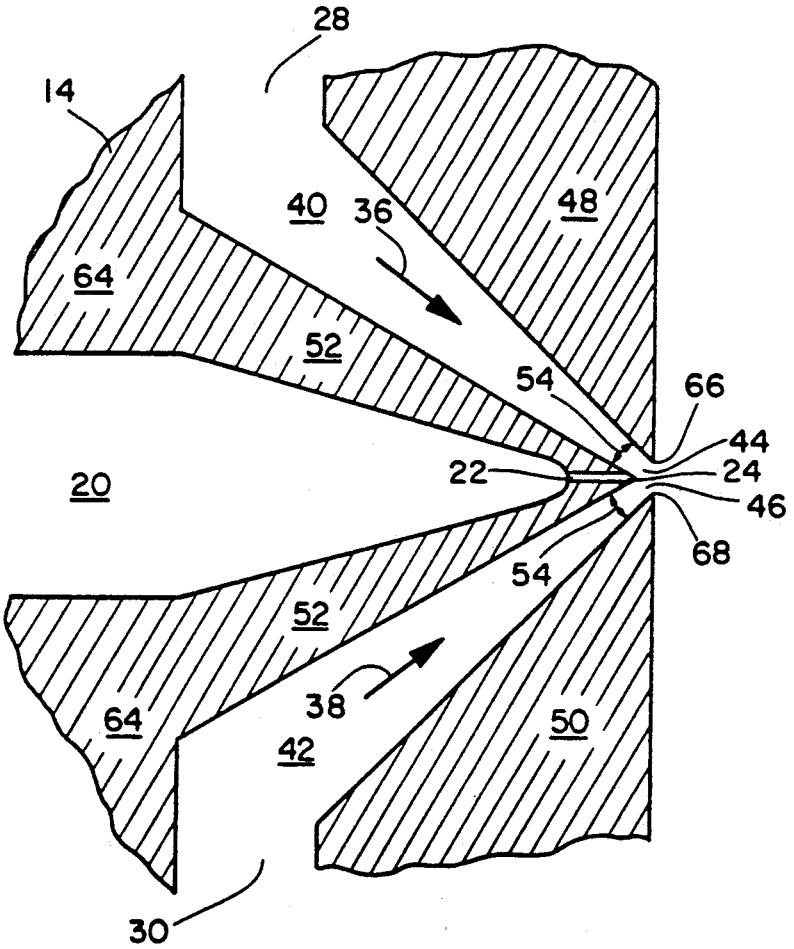
FIG. 3 is a schematic cross-sectional view of the die shown in FIG. 1 along line 2—2 of FIG. 2, illustrating the die in a flush die-tip configuration.

As shown in FIGS. 2 and 3, the meltblowing die 14 includes an extrusion slot 20 which receives the extrudable blend from the extruder 12. The extrudable blend then passes through the extrusion slot 20 and through a plurality of small diameter capillaries or orifices 22 extending across the tip 24 of the die 14 in a linear arrangement, to emerge as molten filaments or threads 26 (shown in FIG. 1). Preferably, the polymer is extrudable at pressures of no more than about 300 psig. Typically, such pressures will be in the range of from about 20 to about 250 psig. More typically, such pressures will be in the range of from about 50 to about 250 psig and most typically from about 125 to about 225 psig. Pressures in excess of these values may rupture or break some dies 14.

Generally speaking, the epoxy/PCL blend is extruded through the capillaries 22 of the die 14 at a rate of from at least about 0.02 gram per capillary per minute to about 1.7 or more grams per capillary per minute, typically from at least about 0.1 gram per capillary per minute to about 1.25 grams per capillary per minute. A more typical range is from at least about 0.3 gram per capillary per minute to about 1.1 grams per capillary per minute.

As shown in FIG. 3, the meltblowing die 14 includes a base portion 64 and a die-tip portion 52 which generally extends centrally from the base portion 64. The centrally located die-tip portion 52 is inwardly tapered to a "knife-edge" point which forms the tip of the die. In order to increase the pressures of extrusion which the die 14 can withstand during operation, it is preferred for the base portion 64 and die-tip portion 52 to be formed from a single block of metal which surrounds the extrusion slot 20 and the extrusion orifices 22.

As also shown in FIG. 3, the die 14 includes attenuating gas inlets 28 and 30 which are provided with heated, pressurized attenuating gas (not shown) by attenuating gas sources 32 and 34 (shown in FIGS. 1 and 2). The heated, pressurized attenuating gas, e.g., heated, pressurized air, enters the die 14 at the inlets 28 and 30 and follows the path generally designated by the arrows 36 and 38 through two chambers 40 and 42 and on through to narrow passageways or gaps 44 and 46 so as to contact the extruded filaments 26 (shown in FIG. 1) as they exit the capillaries 22 of the die 14. The chambers 40 and 42 are designed in a manner such that the heated attenuating gas exits the chambers 40 and 42 and passes through the gas passages 44 and 46 to form a stream (not shown) of attenuating gas which exits the die 14. The temperature and pressure of the heated stream of attenuating gas can vary widely. For example, the heated attenuating gas can be applied at a temperature of from about 110° to about 150° C. The heated attenuating gas can be applied at a pressure of from about 10 to about 45 psig, more specifically from about 18 to about 25 psig.

The die 14 also includes two air plates 48 and 50 which are secured by conventional means to the base portion 64 of the die 14. The air plate 48, in conjunction with the die-tip portion 52 of the die 14, defines the chamber 40 and the attenuating gas air passage or gap 44. The air plate 50, in conjunction with the die-tip 52, defines the chamber 42 and the air passageway or gap 46. Air plate 48 and air plate 50 terminate, respectively, in air plate lip 66 and air plate lip 68. In the configuration illustrated in FIG. 3, the knife edge point which forms the tip 24 of the die-tip portion 52 of the die 14 is flush with the plane formed by the air plate lips 66 and 68. Alternatively, the die-tip portion 52 can be recessed behind or protrude outwardly from the plane formed by the air plate lips 66 and 68.

The position of air plates 48 and 50 may be adjusted relative to the die-tip portion 52 to widen or narrow the width 54 of the attenuating gas passageways 44 and 46 so that the volume of attenuating gas passing through the air passageways 44 and 46 during a given time period can be varied without altering the velocity of the attenuating gas. Generally speaking, it is preferred to utilize attenuating gas pressures of less than about 100 psig in conjunction with air passageway widths, which are usually the same, of no greater than about 0.20 inch (about 5 mm). Lower attenuating gas velocities and wider air passageway gaps are generally preferred if substantially continuous fibers are to be produced.

The two streams of attenuating gas from passageways 44 and 46 converge to form a stream of gas which entrains and attenuates the molten filaments 26 as they exit the linearly arranged capillaries 22 and transforms the filaments into fibers having a diameter less than the diameter of the capillaries 22. The gas-borne fibers are blown by the action of the attenuating gas onto a collecting arrangement which, in the embodiment illustrated in FIG. 1, is a foraminous endless belt 56 conventionally driven by rollers 57. Other foraminous arrangements such as a drum arrangement may be utilized if desired. The belt 56 also may include one or more vacuum boxes (not shown) located below the surface of the foraminous belt 56 and between the rollers 57.

The distance of the collecting arrangement from the die tip (forming distance) should be sufficient to permit at least partial fiber solidification before the fibers contact the collecting arrangement. Furthermore, the fibers should remain on the collecting arrangement for a time sufficient for the resulting nonwoven web to gain sufficient strength or integrity to permit removal of the web from the collecting arrangement.

Because the forming distance and the residence time on the collecting arrangement are dependent upon the epoxy/PCL blend per se and, at least in part, are interdependent, it is not possible to specify precise ranges for each. In general terms, however, the tip 24 of the die-tip portion 52 of the meltblowing die 14 is from about 4 inches (about 10 cm) to about 30 inches (about 76 cm) from the surface of the foraminous endless belt 56 upon which the fibers 26 are collected. The exact forming distance and residence time for use with any specific epoxy/PCL blend and any particular configuration of meltblowing apparatus will be readily determined by persons skilled in the art from the disclosure herein.

It should be noted that forming distance and residence time on the collecting arrangement can have only minimal importance, depending upon the circumstances. Such circumstances might include, by way of illustration, forming the nonwoven web on a carrier sheet which serves as a transporting means for the nonwoven web; the use of two or more meltblowing dies in series for the simultaneous production of a nonwoven web which can function as a carrier sheet; and the like.

FIG. 1 illustrates the formation of substantially continuous fibers on the surface of the belt 56. However, the fibers can be formed in a substantially discontinuous fashion by varying the velocity of the attenuating gas, the temperature of the attenuating gas and the volume of attenuating gas passing through the air passageways in a given time period. The fibers are collected as a fibrous nonwoven web 18 on the surface of the belt 56 which is rotating as indicated by the arrow 58 in FIG. 1. The thus-collected, entangled fibers form a coherent, i.e. cohesive, fibrous nonwoven web 18 which may be removed from the foraminous endless belt 56 by a pair of pinch rollers 60 and 62 which may be designed to press the entangled fibers of the web 18 together to improve the integrity of the web 18. Thereafter, the web 18 may be transported by a conventional arrangement to a wind-up roll (not shown) for storage. Alternatively, the web 18 may be removed directly from the belt 56 by the wind-up roller. The web 18 may be pattern-embossed as by ultrasonic embossing equipment (not shown) or other embossing equipment, such as, for example, the pressure nip formed between heated calendar and anvil rolls (not shown).

In certain embodiments of the invention, after formation, the epoxy/PCL nonwoven webs are treated with a curing agent which reacts with the epoxy groups of the epoxy resin. The curing agent must be of the type which can be applied to the meltblown web without destroying the web's integrity. Thus, the curing agent should be a gas or liquid (solution) which will not dissolve the web. In particular, if a liquid agent or solution is used, it must not be capable of extracting the epoxy resin from the web. Moreover, since PCL polymers have relatively low melting points (e.g., about 60° C.), the curing agent should preferably function at room temperature or below, since elevated temperatures may melt the web.

The curing agent can be of (1) the catalytic type which produces chain extension, (2) the coreactive type which produces chain extension, or (3) the coreactive type which produces chain extension with crosslinking. Agents of the third type (i.e., coreactive agents which produce cross-linking) are in general preferred since they impart solvent resistance to the finished web.

Examples of catalytic agents which produce chain extension only include Lewis bases, e.g., ternary amines, such as, trimethylamine and triethylamine, and Lewis acids, e.g., boron trihalides, such as boron trifluoride. Examples of coreactive agents which produce chain extension only include primary monoamines, e.g., methylamine and ethylamine; secondary diamines, e.g., piperazine; diisocyanates, such as 2,4-tolylene diisocyanate and methylene bis(phenyl isocyanate); and dithiols, such as 1,2-ethanedithiol. Examples of coreactive agents which produce chain extension with crosslinking include ammonia; primary diamines, e.g., poly(glycol amine), isophorone diamine, 1,2-diaminocyclohexane, 4,4'-diaminodiphenylmethane, 4,4'-diaminodiphenyl sulfone, m-phenylenediamine, and N-aminoethylpiperazine; and polyfunctional amines, e.g., diethylenetriamine, triethylenetetramine, tris(aminoethyl)amine, and tris(aminopropyl)amine.

In general terms, the curing takes place by contacting the nonwoven web with the curing agent for a period of time sufficient for the chain extension or chain extension with crosslinking to take place. Although the time needed for curing will vary with the specific curing agent used and the specific composition of the nonwoven web, typical times are on the order of 5 hours for a gaseous curing agent such as ammonia and on the order of 8 hours for a liquid curing agent such as tris(aminoethyl)amine.

Without intending to limit it in any manner, the present invention will be more fully described by the following examples.

EXAMPLE 1

This example illustrates the formation of an epoxy-based nonwoven web from an epoxy/PCL blend.

A 60:40 mixture of EPON® 1009F epoxy resin (Shell Chemical Co., Houston, Tex.) and TONE® P-700 polycaprolactone polymer (Union Carbide Corporation, Danbury, Conn.) was stirred together and added to the hopper of a ¾" single screw extruder (C. W. Brabender Instruments, Inc., extruder model #2503 SPEC) equipped with a mixing screw (screw model #05-00-053). The mixture was blended/extruded at a temperature of about 113° C., with a screw speed of 25 rpm. The extruded strand was allowed to cool in air and subsequently converted into pellets.

The epoxy/PCL blend was formed into a nonwoven web using meltblowing equipment of the general type described above. Specifically, the apparatus consisted of a cylindrical steel hopper/extruder/die combination (hereinafter referred to as a "reservoir") having a capacity of approximately 15 grams. The reservoir was enclosed by an electrically heated steel jacket. The temperature of the reservoir was thermostatically controlled by means of a feedback thermocouple mounted in the body of the reservoir.

The die's extrusion orifices had a diameter of 0.016 inch (0.41 mm) and a length of 0.060 inch (1.5 mm). A second thermocouple was mounted near the die tip. The exterior surface of the die tip was flush with the reservoir body.

Extrusion was accomplished by means of a piston driven by compressed air in the reservoir. The epoxy/PCL blend was extruded (spun) at a melt temperature of 98°-105° C. The extruded filament was surrounded and attenuated by a cylindrical heated air stream exiting a circular 0.075 inch (1.9 mm) gap. Attenuating air pressures typically were of the order of 5-90 psig and temperatures ranged from 93°-121° C. The forming distance was approximately 6 inches (15 cm). The attenuated extruded filament was collected on an aluminum wire screen (standard commercial window screen).

The epoxy/PCL blend was found to extrude successfully. In comparison with other resin systems, the epoxy/PCL system was found to be relatively insensitive to the specific processing temperatures used during the meltblowing procedure. In particular, the blend did not suffer from premature crosslinking in the extruder as can occur with other resins which include reactive groups.

The nonwoven fabric produced from the epoxy/PCL blend had good flexibility, good elongation, and was not glassy.

EXAMPLE 2

The example illustrates the curing of an epoxy/PCL nonwoven web with a curing agent of the chain extension with crosslinking type.

The nonwoven web produced in Example 1 was treated at ambient temperature with a 20% by volume aqueous solution of tris(aminoethyl)amine for approximately 1 hour. Upon heating of the resulting cured web, only the polycaprolactone portion was found to melt, the remainder of the web being infusible. Also, the resulting cured fabric was resistant to a variety of solvents, including acetone, tetrahydrofuran, and methylene chloride.

Although specific embodiments of the invention have been described and illustrated, it is to be understood that modifications can be made without departing from the spirit and scope of the present invention. For example, the epoxy/PCL blends of the invention can be co-formed with discrete particles or fibers of other materials. Also, if a nonwoven web of just an epoxy resin is desired, the polycaprolactone component can be removed from the web after curing by, for example, treating the web with a solvent which dissolves the PCL component but does not effect the cured epoxy component, e.g., by treating the web with chloroform. Other variations and modifications will be evident to persons of ordinary skill in the art from the disclosure herein.

What is claimed is:

1. A method for meltblowing an epoxy resin which comprises the steps of:

(a) forming a molten blend comprising an epoxy resin component which is composed of one or more epoxy resins and a polycaprolactone component which is composed of one or more polycaprolactone polymers;

(b) extruding the molten blend through a plurality of orifices to form filaments;

(c) attenuating the filaments with flowing heated gas so as to produce fibers whose cross-sectional dimensions are less than the cross-sectional dimensions of the orifices; and (d) collecting the fibers in the form of a nonwoven web.

2. The method of claim 1 wherein the epoxy resin component comprises between about 50 percent and about 70 percent by weight of the molten blend.

3. The method of claim 1 wherein the polycaprolactone component comprises between about 30 percent and about 50 percent by weight of the molten blend.

4. The method of claim 1 wherein the epoxy resin component comprises at least about 50 percent by weight and the polycaprolactone component comprises at least about 30 percent by weight of the molten blend.

5. The method of claim 1 wherein the number-average molecular weight of the epoxy resin component is between about 900 and about 8,000.

6. The method of claim 1 wherein the functionality of the one or more epoxy resins making up the epoxy resin component is at least two.

7. The method of claim 1 wherein the number-average molecular weight of the polycaprolactone component is between about 30,000 and about 60,000.

8. The method of claim 1 comprising the additional step of contacting the nonwoven web with a curing agent which reacts with the epoxy groups of the one or more epoxy resins.

9. The method of claim 8 wherein the curing agent is of the crosslinking type.

10. The method of claim 9 wherein the curing agent is selected from the group consisting of ammonia, primary diamines, and polyfunctional amines.

11. The method of claim 10 wherein the curing agent is ammonia.

12. The method of claim 10 wherein the curing agent is tris(aminoethyl)amine.

13. A nonwoven web comprising fibers which are composed of at least about 50 percent by weight of one or more epoxy resins and at least about 30 percent by weight of one or more polycaprolactone polymers.

14. The nonwoven web of claim 13 wherein the one or more epoxy resins comprise between about 50 percent and about 70 percent by weight of the fibers.

15. The nonwoven web of claim 13 wherein the one or more polycaprolactone polymers comprise between about 30 percent and about 50 percent by weight of the fibers.

16. The nonwoven web of claim 13 wherein the number-average molecular weight of the one or more epoxy resins is between about 900 and about 8,000.

17. The nonwoven web of claim 13 wherein the functionality of the one or more epoxy resins is at least two.

18. The nonwoven web of claim 13 wherein the number-average molecular weight of the one or more polycaprolactone polymers is between about 30,000 and about 60,000.

19. The nonwoven web of claim 13 wherein at least some of epoxy groups of the one or more epoxy resins has been reacted with a curing agent.

20. The nonwoven web of claim 19 wherein the curing agent is of the crosslinking type.

21. The nonwoven web of claim 20 wherein the curing agent is selected from the group consisting of ammonia, primary diamines, and polyfunctional amines.

22. The nonwoven web of claim 20 wherein the curing agent is ammonia.

23. The nonwoven web of claim 20 wherein the curing agent is tris(aminoethyl)amine.

24. An article of manufacture which comprises the nonwoven web of claim 13.

25. An article of manufacture which comprises the nonwoven web of claim 21.

* * * * *

UNITED STATES PATENT AND TRADEMARK OFFICE

CERTIFICATE OF CORRECTION

PATENT NO. : 5,100,435

DATED March 31, 1992

INVENTOR(S) : Fidelis C. Onwumere

It is certified that error appears in the above-identified patent and that said Letters Patent is hereby corrected as shown below:

Column 4, line 31 & 32, "produced" should read --produce--;

Column 4, line 63, "only are not" should read --only and not--;

Signed and Sealed this

Twelfth Day of October, 1993

Bruce Lehman

*Attest:*

BRUCE LEHMAN

*Attesting Officer*

*Commissioner of Patents and Trademarks*